US005653178A

United States Patent [19]

Huczka

[11] Patent Number: 5,653,178

[45] Date of Patent: Aug. 5, 1997

[54] RAILING SUPPORTED FOLDING TABLE

[76] Inventor: Louis Huczka, 5910 Boisvert Terrace, St-Hubert, Québec, Canada, J3Y 5Y4

[21] Appl. No.: 527,196

[22] Filed: Sep. 12, 1995

[30] Foreign Application Priority Data

Sep. 14, 1994 [CA] Canada ..... 2132079

[51] Int. Cl.[6] ..... A47B 5/00

[52] U.S. Cl. ..... 108/47; 108/135

[58] Field of Search ..... 108/47, 135, 134; 105/152; 312/315

[56] References Cited

U.S. PATENT DOCUMENTS

| | | | |
|---|---|---|---|
| 1,613,857 | 1/1927 | Tonguette et al. | 108/135 |
| 1,630,889 | 5/1927 | Clarke . | |
| 2,593,222 | 4/1952 | Tracy . | |
| 2,672,988 | 3/1954 | Johnson . | |
| 2,921,824 | 1/1960 | Richter | 108/134 |
| 4,570,803 | 2/1986 | Peterson . | |
| 4,836,480 | 6/1989 | Besner . | |
| 4,850,282 | 7/1989 | Postic . | |
| 4,889,057 | 12/1989 | Chartrand . | |
| 5,148,755 | 9/1992 | Morales . | |

FOREIGN PATENT DOCUMENTS

| | | | |
|---|---|---|---|
| 0199814 | 2/1948 | Austria | 108/135 |
| 0532596 | 11/1956 | Canada . | |
| 0375118 | of 1964 | Germany | 108/152 |
| 0120785 | 2/1948 | Sweden | 108/135 |
| 0169694 | 12/1959 | Sweden | 108/47 |
| 0176311 | 4/1935 | Switzerland | 108/47 |
| 0323053 | 12/1929 | United Kingdom | 108/47 |

*Primary Examiner*—Peter M. Cuomo
*Assistant Examiner*—Gerald Anderson
*Attorney, Agent, or Firm*—Merek & Voorhees

[57] ABSTRACT

A folding table adapted to be hooked to the handrail of a vertical railing is disclosed herein. The table includes a pair of upright supports comprising adjustable hooks to allow for different widths of handrails. A table top is pivotally mounted, between the upright supports, to a bottom portion of the upright supports. The folding table also includes a vertical adjustment device to allow the levelling of the table regardless of the construction of the railing. A safety screen extending from the table top to the top of the upright supports, prevents objects from directly falling off the table.

22 Claims, 2 Drawing Sheets

RAILING SUPPORTED FOLDING TABLE

FIELD OF THE INVENTION

The present invention relates to tables. More specifically, the present invention relates to folding tables that may be supported to vertical railings or the like.

BRIEF DESCRIPTION OF THE PRIOR ART

Nowadays, people use conventional tables on their balconies and decks when they need a horizontal support to hold glasses, plates, food and the like.

Various drawbacks are associated with the use of conventional tables on balconies or decks: they take up too much room, they are bulky and awkward, they become unsightly with time, they are difficult to store and to move, and they provide inadequate safety features.

The prior art is replete with various portable trays or tables for purposes similar to the purpose of the conventional table used on balconies.

For example, U.S. Pat. No. 4,889,057 issued to Chartrand on Dec. 26, 1989, discloses a foldable panel attached to a frame. The panel can be unfolded from the frame to define selectively a table or a seat. The frame is secured to the vertical rail section of a balcony by a pair of blocks including wing nut fasteners. However, the frame is not vertically adjustable, e.g., it must follow the angle of the railing to which it is attached which may cause sliding of the objects placed on the table if the railing is not vertical. Furthermore, there are no provisions to ensure that the panel stays in a folded position when it is not in use.

Canadian Patent No. 532,596 issued to Willis on Nov. 6, 1956 discloses a portable picnic table having brackets for attachment to the bumper of an automobile.

OBJECT OF THE INVENTION

An object of the present invention is therefore to provide an improved railing supported folding table.

Another object of the invention is to provide a railing supported folding table having a vertical adjustment mechanism to ensure that the table is in a horizontal orientation when it is in the unfolded position.

SUMMARY OF THE INVENTION

More specifically, in accordance with the present invention, there is provided a folding table adapted to be mounted to a railing having a handrail and a plurality of substantially vertical posts, said folding table comprising:

a first and a second spaced apart upright supports;

first and second securing means for securing said first and second upright supports to the handrail of the railing;

a table top pivotally mounted to said first and second supports; said table top being so mounted as to be pivotable between a first closed position and a second open position; and adjustment means for adjusting said first and second upright supports so that said table top lies in a horizontal plane when in said open position.

The objects, advantages and other features of the present invention will become more apparent upon reading of the following non restrictive description of preferred embodiments thereof, given by way of example only with reference to the accompanying drawings.

DETAILED DESCRIPTION OF THE PREFERRED EMBODIMENT

Figure 1:
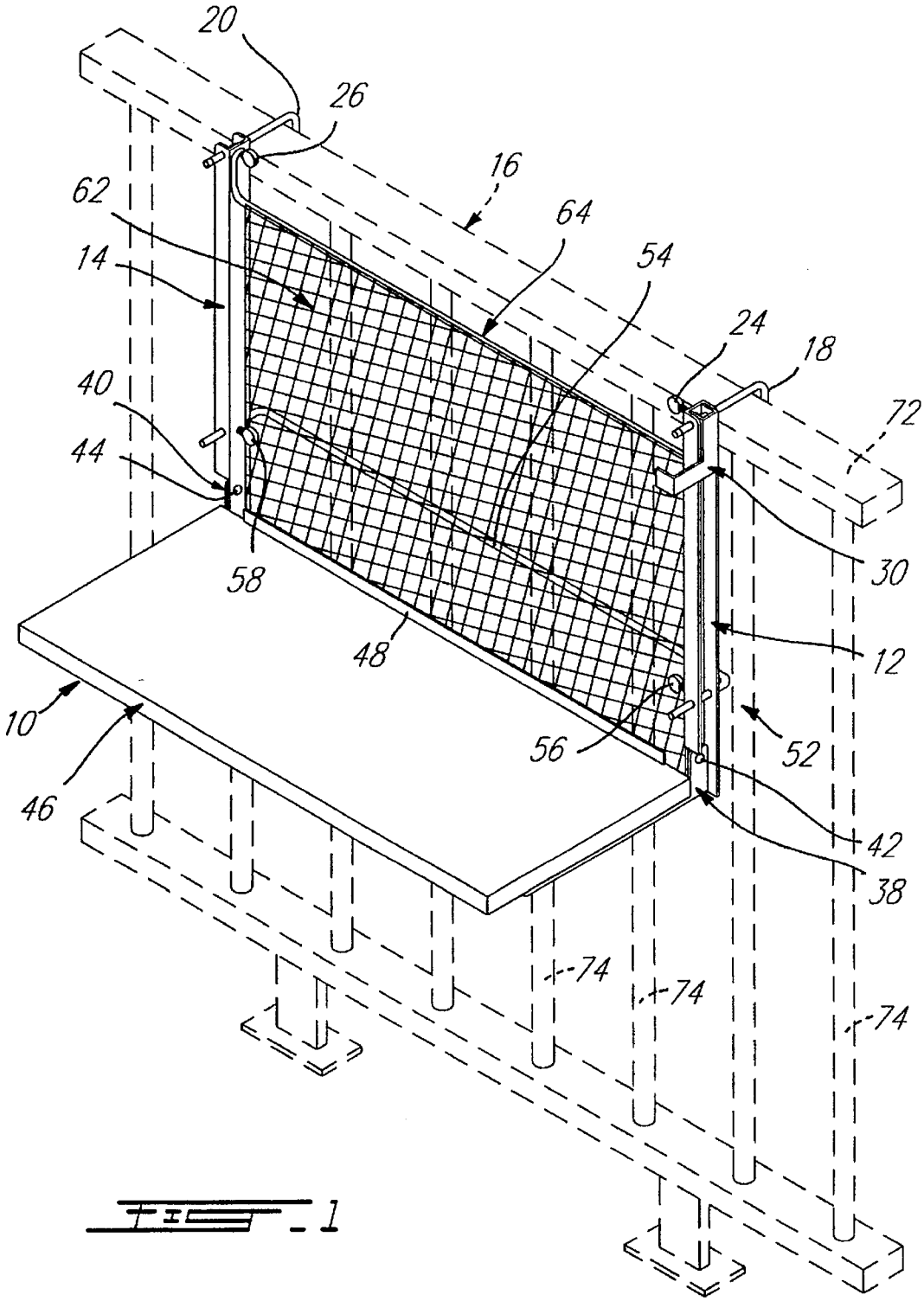
FIG. 1 is an isometric view of a preferred embodiment of the railing supported folding table of the present invention in an open position on a conventional balcony rail.
Figure 2:
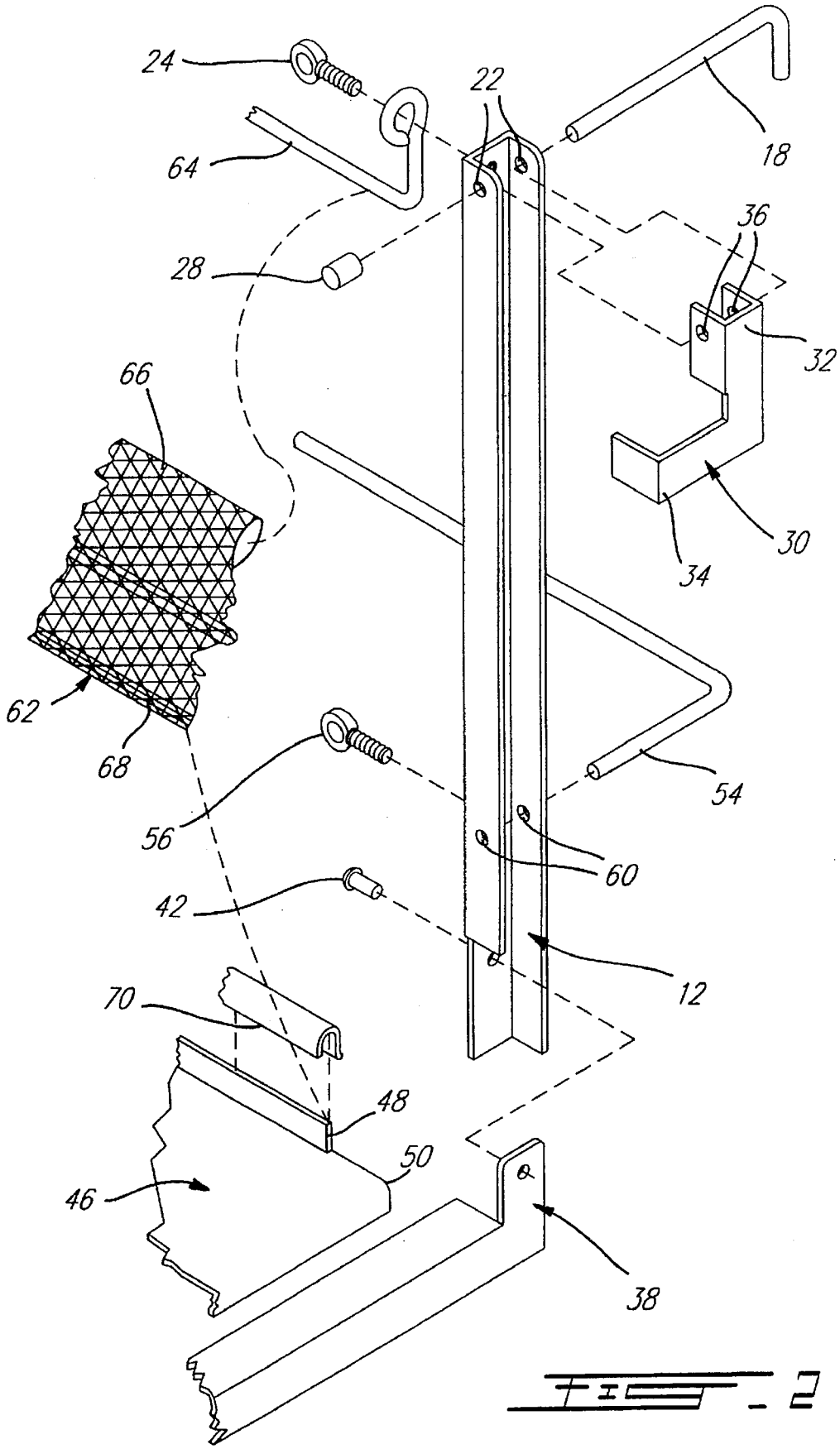
FIG. 2 is an exploded view of a portion of the railing supported folding table of FIG. 1.

FIG. 1 of the appended drawings illustrates a preferred embodiment of a railing supported foldable table 10 that includes a first and second upright generally U-shaped channels 12 and 14 mounted to a conventional railing 16 (in dashed lines) by first and second adjustable hanging hooks 18 and 20. The hooks 18 and 20 are mounted to the channels 12 and 14 through apertures 22 located in an upper portion of the channels 12 and 14 (see FIG. 2). A pair of fasteners 24 and 26 are provided to hold the hanging hooks 18 and 20 in place when they are adequately positioned as will be explained hereinafter. A plastic protective cap 28 may be installed at the end of the hanging hooks 18 and 20 to prevent injuries.

A locking mechanism 30 is provided at the upper portion of the first upright channel 12. The locking mechanism has a U-shaped portion 32 adapted to enter the channel 12 and a L-shaped portion 34. The U-shaped portion includes apertures 36 that can be aligned with the apertures 22 of the channel 12 to therefore mount the locking mechanism 30 to the channel 14 through the first adjustable hanging hook 18.

The folding table 10 also includes first and second L-shaped table support elements 38 and 40 which are pivotally mounted to a lower portion of the first and second channels 12 and 14, respectively, by rivet pins 42 and 44. A table top 46, made of a rigid material, is secured to the table supports 38 and 40 by conventional means such as fastening, welding molding or the like. Since the rivet pins 42 and are colinear, it is possible to fold and unfold the table top 46 with respect to the channels 12 and The table top 46 also includes a flange 48 mounted at a rear edge 50 thereof.

The folding table 10 also includes a vertical adjustment mechanism 52 comprising a C-shaped levelling bar 54 and first and second fasteners 56 and 58. The upright channels 12 and 14 include apertures 60 adapted to allow the levelling bar 54 to be slidably inserted therein (see FIG. 2) to thereby maintain the bar 54 horizontally between the uprights channels 12 and 14. The fasteners 56 and 58 may hold the bar 54 in place when the latter is adequately positioned as will be explained hereinafter.

A safety screen 62 is vertically mounted between the upright channels 12 and 14. A wire 64, threaded in an upper portion 66 of the safety screen 62, is secured between the fasteners 24 and 26, thereby maintaining the upper portion of the safety screen in place between the upright channels 12 and 14. A lower portion 68 of the safety screen 62 is mounted to the flange 48 through a C-shaped retainer channel 70.

In operation, the railing supported folding table may be hooked to a handrail 72 of a vertical railing 16 by means of the hanging hooks 18 and 20. It is to be noted that the hooks 18 and 20 may be adjusted to fit various widths of handrail 72 by sliding the hooks 18 and 20 in the apertures 22 of the upright channels 12 and 14 and then by tightening the fasteners 24 and 26.

FIG. 1 illustrates the table top 46 in an unfolded position. As can be seen, the table top 46 has an orientation which is substantially perpendicular to the orientation of the upright channels 12 and 14. Therefore, if the upright channels 12 and 14 are in a vertical orientation, the table top 46 is in a horizontal orientation when unfolded.

The levelling bar 54 may be adjusted so that the channels 12 and 14 lie in a generally vertical orientation. Indeed, if the fasteners 56 and 58 are untightened, it is possible to push the levelling bar 54 against the vertical posts 74 of the railing 16 to thereby bring the channels 12 and 14 to a substantially vertical orientation. It is therefore possible to properly level the table top 46 regardless of the vertical slant of the railing 16.

It is to be noted that, when the table top is pivoted about the rivet pins 42 and 44, so as to be in a folded position (not shown), the locking mechanism 30 may be used to maintain the table top 46 in this folded position. Indeed, the L-shaped portion 34 of the locking mechanism 30 may be positioned so as to prevent the table top 46 to fall back in the position illustrated in FIG. 1 since the locking mechanism is pivotally mounted to the channel 14 through the hanging hook 18 as previously discussed. To do this, a user simply has to pivot the locking mechanism 30 in a counterclockwise direction about hook 18, maintain the locking mechanism 30 in this position, pivot the table top 46 upwardly about rivets 42 and 44, and pivot the locking mechanism 30 in the position illustrated in FIG. 1. The folding table 10 may then be subsequently unfolded again or removed from the railing 16.

It is to be noted that the fasteners 24, 26, 56 and 58 may advantageously be thumb screws to allow operation of these fasteners without the need of tools. It is also to be noted that various material can be used in the fabrication of the various components of the railing supported folding table. As non limitative examples, high density plastic or wood could be used for the table top 46; mesh fabric could be used for the safety screen 62 and chrome plated steel could be used for the other parts of the folding table.

A major advantage arises from the use of the hanging hooks 18 and 20 to suspend the folding table 10 from the handrail 72 of the railing 16; it is possible to easily remove the folding table 10 from the railing 16, without the need for tools, by an upward motion of the folding table 10 with respect to the railing 16.

The safety screen 62 prevents objects placed on the table top 46 from falling off the table top 46 through the vertical posts 74 of the railing 16.

It is also to be noted that, by using a levelling bar to ensure the horizontal orientation of the table top, it is possible to suspend the above described folding table on a railing having glass panels instead of posts. Indeed, the pressure applied on the glass plate is not concentrated on one or two particular locations but is distributed along the length of the levelling bar, thereby decreasing the likelihood of glass panels breakage.

Although the present invention has been described hereinabove byway of a preferred embodiment thereof, this embodiment can be modified at will, within the scope of the appended claims, without departing from the spirit and nature of the subject invention.

What is claimed is:

1. A folding table adapted to be mounted to a railing having a handrail and a plurality of substantially vertical posts, said folding table comprising:

a support assembly;

securing means for securing said support assembly to the handrail of the railing;

a table top pivotally mounted to said support assembly so as to be pivotable between a first closed position and a second open position; and adjustment means vertically spaced apart from said securing means and interposed between said railing and said support assembly for pivoting said support assembly about said securing means to an angular position in which said table top lies in a horizontal plane when in said open position; said adjustment means including a substantially horizontal levelling bar so mounted to said support assembly as to be transversely movable with respect to said support assembly; a portion of said bar being interposed between said railing and said support assembly and being adapted to rest on said vertical posts of said railing.

2. A folding table as defined in claim 1, wherein said bar is substantially C-shaped and includes first and second branches adapted to be mounted to said support assembly.

3. A folding table adapted to be mounted to a railing having a handrail and a plurality of substantially vertical posts, said folding table comprising:

first and second generally upright supports including apertures;

first and second securing means for securing said first and second upright supports to the handrail of the railing;

a table top pivotally mounted to said first and second generally upright supports so as to be pivotable between a first closed position and a second open position; and adjustment means for adjusting said first and second upright supports so that said table top lies in a horizontal plane when in said open position; said adjustment means including a substantially C-shaped horizontal levelling bar including first and second branches mounted to said apertures of said first and second upright supports, respectively; a portion of said levelling bar being adapted to rest on vertical posts of the railing.

4. A folding table as defined in claim 3, wherein each said first and second upright supports includes a fastener to releasably secure said first and second branches of said c-shaped horizontal levelling bar to said first and second upright supports, respectively.

5. A folding table as defined in claim 4, wherein each said first and second securing means for securing said first and second upright supports to said handrail of said railing consists of an L-shaped hook member.

6. A folding table as defined in claim 5, wherein each said first and second upright supports includes apertures adapted to slidably receive said L-shaped hook member.

7. A folding table as defined in claim 6 wherein each said first and second upright supports includes a fastener to releasably secure said first and second L-shaped hook members.

8. A folding table as defined in claim 7, wherein one of said first and second upright supports includes a retaining member to releasably maintain said table top in said first closed position.

9. A folding table as defined in claim 8 further comprising a vertical safety screen mounted to said upright supports to thereby prevent objects placed on said table top from falling off between the vertical posts of said railing.

10. A folding table as defined in claim 9, wherein said vertical safety screen is made of a meshed fabric material.

11. A folding table adapted to be mounted to a railing having a handrail and a plurality of substantially vertical posts, said folding table comprising:

a support assembly including first and second generally upright supports;

securing means for securing said support assembly to the handrail of the railing;

a table top having first and second L-shaped table supports pivotally mounted to said first and second generally upright supports, respectively; said table supports being so mounted to said first and second generally upright supports as to allow said table top to be pivoted between a first closed position and a second open position; each of said first and second table supports having an abutting portion for abutting against said support assembly, a relatively long portion mounted to said table top and a relatively short portion pivotally mounted to said first and second upright supports, respectively, when said table top reaches said open position, therefore preventing further pivoting of said table top; and adjustment means interposed between said railing and said support assembly for pivoting said support assembly about said securing means to an angular position in which said table top lies in a horizontal plane when in said open position.

12. A folding table as defined in claim 11, wherein said relatively short portion of each said first and second table supports has a free end provided with an aperture and wherein each said upright support is provided with a corresponding aperture, said first and second table supports being pivotally mounted to said first and second upright supports, respectively, through a pivot pin; said abutting portion being formed by said short portions of said first and second table supports.

13. A folding table as defined in claim 11, wherein said adjustment means include a substantially horizontal levelling bar mounted to said first and second upright supports; a portion of said bar being interposed between said railing and said support assembly and being adapted to rest on said vertical posts of said railing.

14. A folding table as defined in claim 13, wherein said bar is substantially C-shaped and includes first and second branches adapted to be mounted to said first and second upright supports, respectively.

15. A folding table as defined in claim 14, wherein each of said first and second upright supports includes mounting apertures sized to receive said first and second branches of said C-shaped horizontal levelling bar.

16. A folding table as defined in claim 15, wherein each of said first and second upright supports includes a fastener to releasably secure said first and second branches of said C-shaped horizontal levelling bar to said first and second upright supports, respectively.

17. A folding table as defined in claim 16, whereto each of said first and second securing means for securing said first and second upright supports to said handrail of said railing consists of an L-shaped hook member.

18. A folding table as defined in claim 17, wherein each of said first and second upright supports includes apertures adapted to slidably receive said L-shaped hook member.

19. A folding table as defined in claim 18, wherein each of said first and second upright supports includes a fastener to releasably secure said first and second L-shaped hook members.

20. A folding table as defined in claim 19, wherein of said first and second upright supports includes a retaining member to releasably maintain said table top in said first closed position.

21. A folding table as defined in claim 20, further comprising a vertical safety screen mounted to said Upright supports to thereby prevent objects placed on said table top from falling off between the vertical posts of said railing.

22. A folding table as defined in claim 21, wherein said vertical safety screen is made of a meshed fabric material.

* * * * *